US006193800B1

(12) United States Patent
Nakashima

(10) Patent No.: US 6,193,800 B1
(45) Date of Patent: Feb. 27, 2001

(54) GLASS SPRAYING METHOD AND APPARATUS

(75) Inventor: Mikio Nakashima, Aichi (JP)

(73) Assignee: Kabushiki Kaisha Nakashima, Kanagawa-Ken (JP)

( * ) Notice: Subject to any disclaimer, the term of this patent is extended or adjusted under 35 U.S.C. 154(b) by 0 days.

(21) Appl. No.: 09/401,802

(22) Filed: Sep. 22, 1999

(30) Foreign Application Priority Data

Nov. 30, 1998 (JP) ..... 10-340389

(51) Int. Cl.[7] ..... B05B 13/04
(52) U.S. Cl. ..... 118/321; 118/320
(58) Field of Search ..... 118/302, 307, 118/320, 319, 321; 29/895.32, 895.3, 895.33, 895.21, 895.212; 492/28, 53; 427/422, 452, 453, 318, 376.4, 425

(56) References Cited

U.S. PATENT DOCUMENTS 3,156,033 * 11/1964 Brown ..... 29/895.32
3,850,647 * 11/1974 Bhat et al. ..... 106/1.12
3,872,419 * 3/1975 Groves et al. ..... 338/25
5,237,747 * 8/1993 Nakashima ..... 29/895.32

* cited by examiner

*Primary Examiner*—Richard Crispino
*Assistant Examiner*—Yewebdar T. Tadesse
(74) *Attorney, Agent, or Firm*—Arent Fox Kintner Plotkin & Kahn, PLLC

(57) ABSTRACT

The method comprises a preheating step to heat a metal base 10 entirely, a pre-spraying step to for a glass pre-coating 13 by pre-spraying a glass material onto the surface of the preheated base, a main-spraying step to form a glass coating 14 by additionally heating the glass pre-coating formed in the previous step and main-spraying a like glass material onto the surface.

3 Claims, 5 Drawing Sheets

GLASS SPRAYING METHOD AND APPARATUS

BACKGROUND OF THE INVENTION

1. Field of the Invention

The present invention relates to a glass spraying method and apparatus for forming a glass coating on a metal surface.

2. Description of the Related Art

For example, as a roll for printing or an industrial roll used for papermaking or steelmaking, rolls made of metal have been used widely. Since the metallic rolls are brought into contact with a printing ink exhibiting a strong acidity or alkalinity, a cleaning solution, paper or metallic products, etc., the deterioration in quality of the surfaces of the metallic rolls is accelerated with time due to corrosion, etc. The rolls are, in many cases, used under hostile conditions such as high temperature and high humidity and have a problem that they are inferior in durability since the surface thereof is deteriorated rapidly due to the contamination on the roll surface.

Furthermore, a roll for conveying goods or articles or a guiding roll have preferably electrically insulating property since it has been recently used with electronic equipment, and it is preferable that contaminant hardly stick to the roll surface or can be removed easily from the surface if the contaminant sticks to the surface.

To solve the above-mentioned technical problems, a roll having a glass coating on the surface thereof has been proposed. The inventors has disclosed a roll base having a glass surface and a method for manufacturing the same in Japanese Kokai No. 4-99259 and a spray gun for a spraying apparatus useful for forming a glass coating in Japanese Patent No. 2562801. A technology to form a glass coating sprayed on the surface of a metallic roll is disclosed in Kokai No. 64-13324.

It is needless to say that controlling the temperature of a metallic base is important upon forming a glass coating by spraying a glass material onto the metallic base. According to the research of the inventors, it is important to heat the metallic base, upon spraying, to a high temperature of about 600 to 1000° C. which is above a softening point of a glass, to form a glass coat of a high quality. However, apart from a small roll, it requires a long period of time and an enormous amount of energy to entirely heat a huge metallic base to a temperature of 600 to 1000° C., which is commonly used for the previously mentioned industrial roll whose diameter and length sometimes amount to 200 to 300 mm and 1000 mm or more, respectively.

On the other hand, when a metallic base is kept under such a high temperature, a base made of an iron material such as SS41 may be deteriorated or a serious problem in forming a glass coating may occur in a base made of a martensitic stainless steel due to a significant change in thermal expansion coefficient.

Furthermore, when a glass coating having been formed by spraying is subjected to a high temperature for a long time (about 60 min or more depending on the components), the glass layer is recrystallized resulting in the deterioration of the glass.

When a glass material of a high temperature is directly sprayed onto the surface of a metallic base, the base surface is oxidized to form a oxide film (so-called black rust) resulting in a lowered adhesion strength of the glass coating to the metallic base. To prevent the formation of the oxide film, it has been proposed to provide, for example, an under-coat layer of stainless in above mentioned Kokai No. 4-99259 and an under-coat layer of an alloy of such as Ni—Cr in Kokai No. 64-13324.

However, when the metallic under-coat of stainless or an alloy is formed, air intervening between the surface of the metallic base and the under-coat is heated by high temperature upon spraying the glass material and may be trapped as air bubbles in the glass coating. The air bubbles thus formed have a diameter of 10–44 μm at the smallest and of 66 μm at the largest and appear on the surface of the glass coating after polishing as minute pin holes resulting in lowered commercial value of the product.

The adhesion between the metallic under coat layer of stainless or an alloy and the glass coating is not good. In addition, the adhesion rate of stainless or an alloy upon forming the metallic under coat layer by spraying, is about 60 to 70% and the availability of the material is not good.

SUMMARY OF THE INVENTION

The main object of the present invention, which has been proposed based on the above circumstances, is to spray a glass material onto a metallic base effectively and efficiently. The present invention also provides a glass spraying method wherein the generation of the pin holes in the glass coating is prevented and the strength, adhesion strength and the appearance of the resulting glass coating is largely improved. Furthermore, the present invention provides an apparatus useful for spraying glass onto a metallic roll base, particularly a large metallic roll base.

To achieve the above-mentioned object, an invention of a glass spraying method described in claim 1 is proposed. The invention of claim 1 comprises a preheating step to heat a metallic base entirely, a pre-spraying step to form a glass pre-coating by pre-spraying a glass material onto the surface of the preheated base, and a main-spraying step to form a glass coating by additionally heating the glass pre-coating formed in the previous step and main-spraying a like glass material onto the surface thereof.

The invention of claim 2 relates to a glass spraying method according to claim 1, further comprising a post-heating step following the main-spraying step wherein the glass coating which has been formed by main-spraying is heated.

The invention of claim 3 relates to a glass spraying method according to claim 1 or 2, wherein a glass pre-coating having a thickness of 50 μm to 200 μm is formed in the pre-spraying step.

The invention of claim 4 relates to a glass spraying method according to claim 1, wherein the metallic base is a metallic roll base which is held to be rotatable in the circumferential direction, so that said steps are performed while rotating the metallic roll base.

The invention of claim 5 relates to a glass spraying method according to claim 4, wherein the pre-spraying step, the main-spraying step and the post-heating step are performed by an apparatus which moves continuously along the axial direction of the metallic roll base.

The invention of claim 6 relates to an glass spraying apparatus comprising, a rotating and holding apparatus which holds a metallic roll base and rotates the same in the circumferential direction thereof, an entire heating apparatus disposed in the axial direction of the roll base to heat the roll base entirely, a pre-spraying apparatus which moves along the axial direction of the roll base and sprays a glass material onto the surface of the roll base in sequence to form a glass pre-coating, an additional heating apparatus which moves along the axial direction of the roll base and heats additionally the glass pre-coating locally and continuously, and a main-spraying apparatus disposed on the rear side of the additional heating apparatus in the direction of travel thereof, which sprays a glass material in sequence onto the surface of the glass pre-coating which has been additionally heated.

The invention of claim 7 relates to an glass spraying apparatus according to claim 6, further comprising a post-heating apparatus disposed on the rear side of the main-spraying apparatus in the direction of travel thereof, which heats the glass-coating which has been subjected to the main-spraying.

The invention of claim 8 relates to an glass spraying apparatus according to claim 6 or 7, wherein the additional heating apparatus, the main-spraying apparatus, and the post-heating apparatus are arranged so that they are moved together at one time.

DESCRIPTION OF THE PREFERRED EMBODIMENTS

The present invention will be explained below in detailed with reference to the attached drawings.

Figure 1:
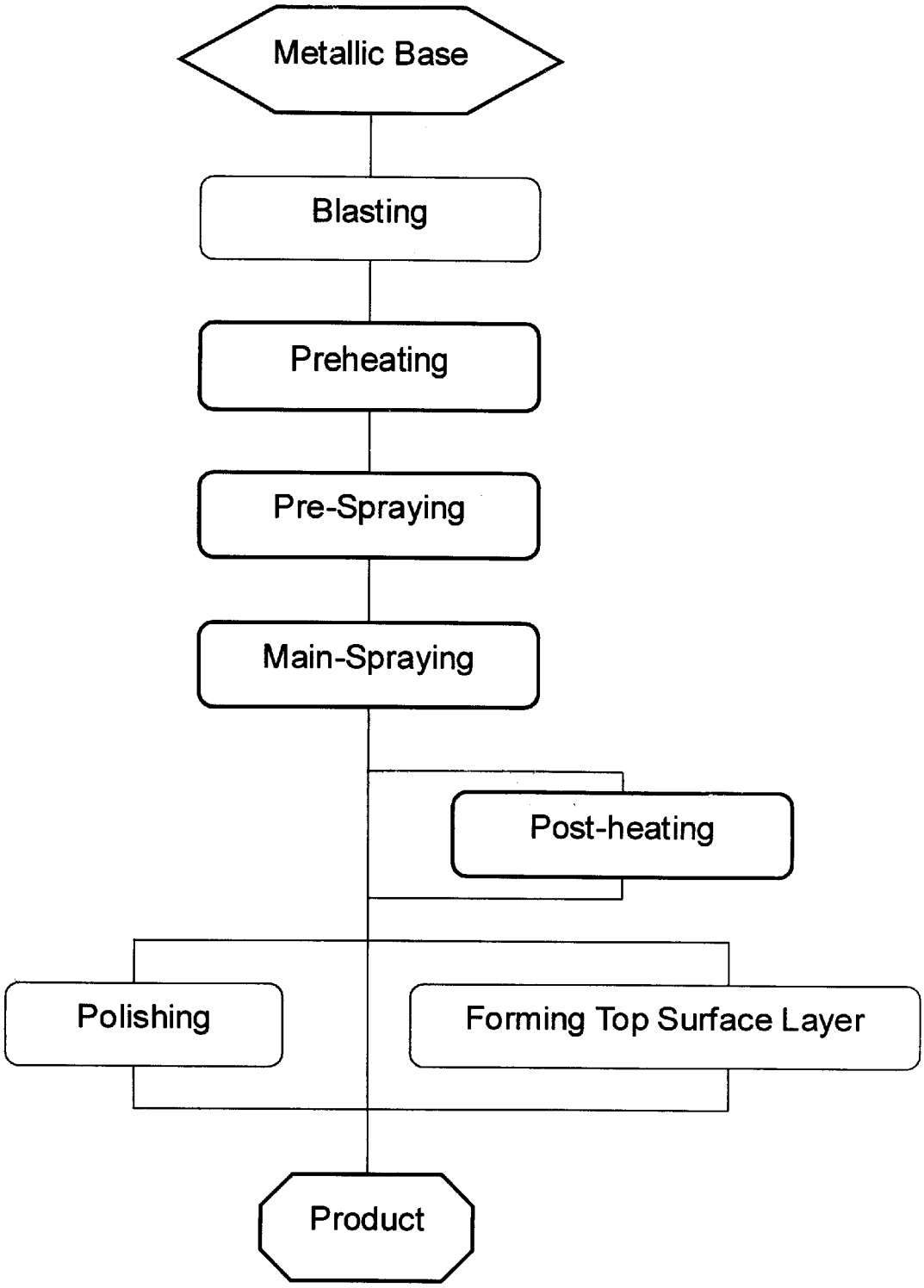
FIG. 1 is a schematic diagram showing a glass spraying method of the present invention.
Figure 2:
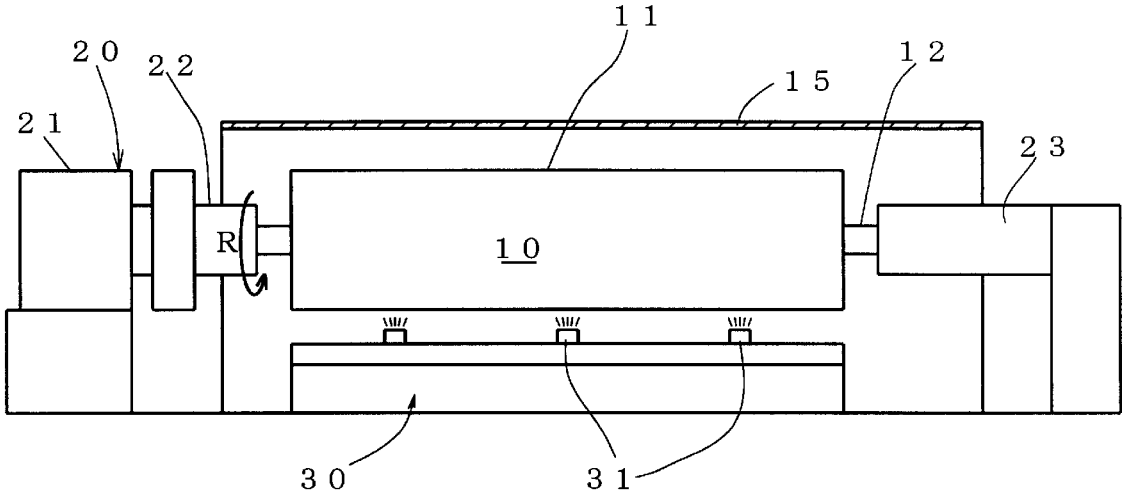
FIG. 2 is a longitudinal sectional view of a glass spraying apparatus showing the preheating step.
Figure 3:
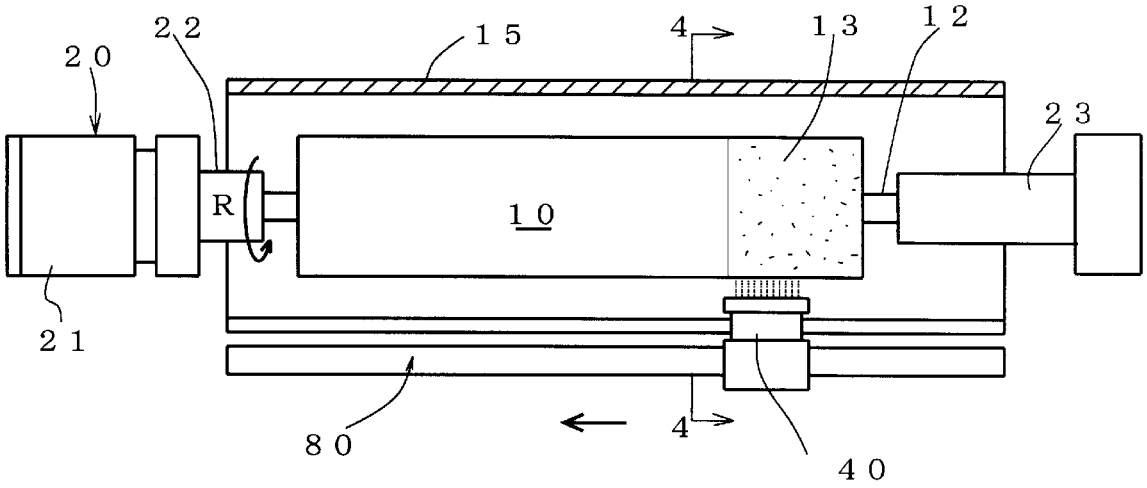
FIG. 3 is a transverse sectional view of the same apparatus showing the pre-spraying step.
Figure 4:
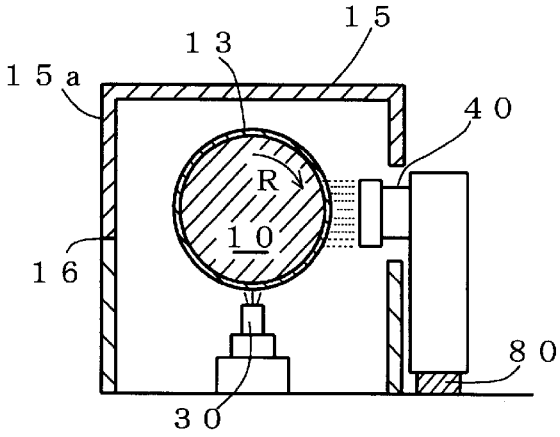
FIG. 4 is a sectional view taken along the lines 4—4 of FIG. 3.
Figure 5:
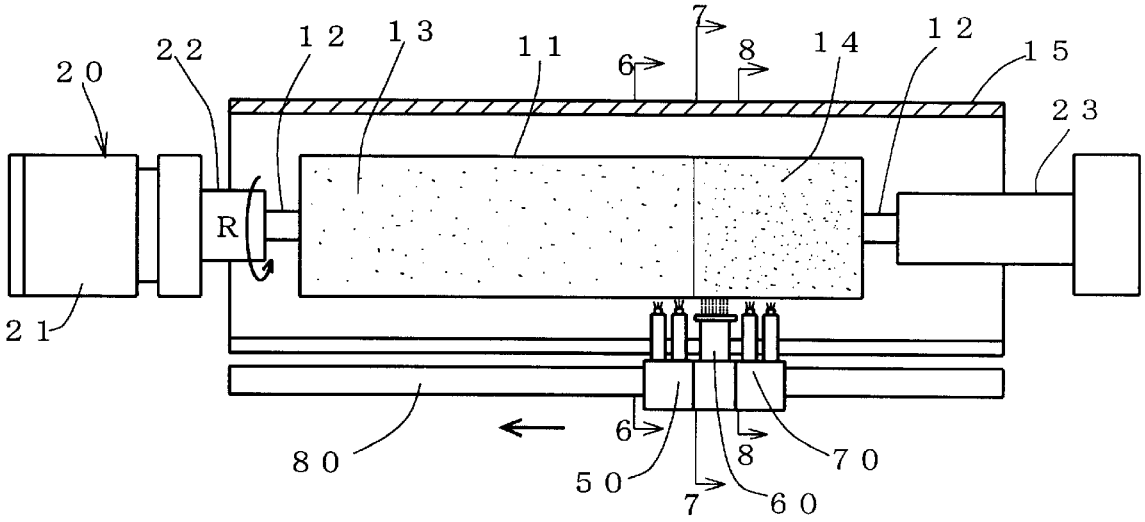
FIG. 5 is a transverse sectional view of the same apparatus showing the main-spraying step.
Figure 6:
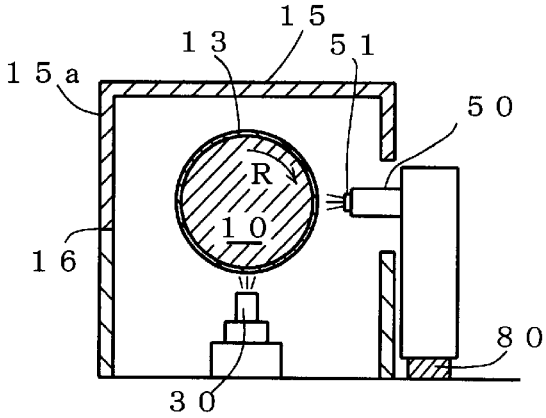
FIG. 6 is a sectional view taken along the lines 6—6 of FIG. 5.
Figure 7:
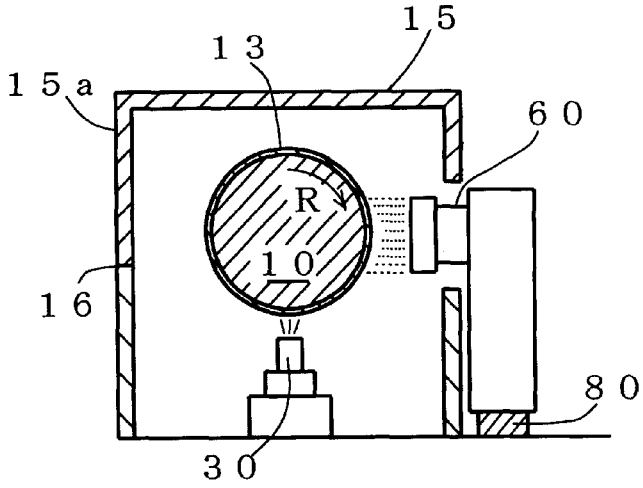
FIG. 7 is a sectional view taken along the lines 7—7 of FIG. 5; and, FIG. 8 is a sectional view taken along the lines 8—8 of FIG. 5.
Figure 8:
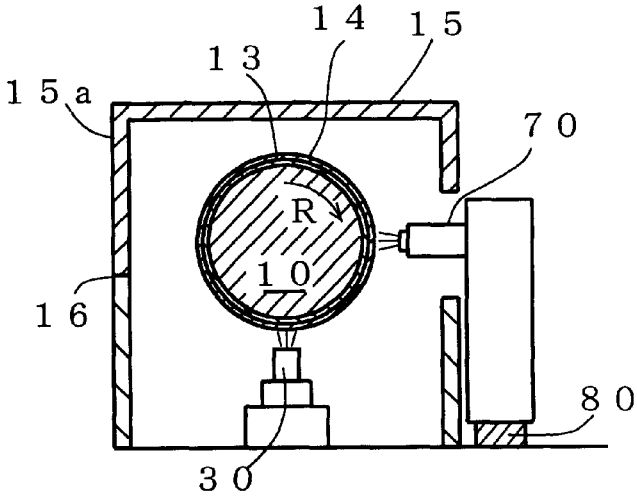

FIG. 1 is a schematic diagram showing a glass spraying method of the present invention, FIG. 2 is a longitudinal sectional view of a glass spraying apparatus showing the preheating step, FIG. 3 is a transverse sectional view of the same apparatus showing the pre-spraying step, FIG. 4 is a sectional view taken along the lines 4—4 of FIG. 3, FIG. 5 is a transverse sectional view of the same apparatus showing the main-spraying step, FIG. 6 is a sectional view taken along the lines 6—6 of FIG. 5, FIG. 7 is a sectional view taken along the lines 7—7 of FIG. 5, and FIG. 8 is a sectional view taken along the lines 8—8 of FIG. 5.

First of all, the invention relating to a method for glass spraying described in claim 1 will be explained.

As shown in the schematic diagram of FIG. 1, the glass spraying method relating to the invention of claim 1 comprises a preheating step to heat a metallic base entirely, a pre-spraying step to form a glass pre-coating by pre-spraying a glass material onto the surface of the preheated base, and a main-spraying step to form a glass coating by additionally heating the glass pre-coating formed in the previous step and main-spraying a like glass material onto the surface thereof.

In the preheating step, the entire metal base of a room temperature is heated to a predetermined temperature. As described below with reference to FIG. 2, the heating is performed by heating burners 31 of the entire heating apparatus 30 placed in a heating chamber 15. The preheating step is performed at a temperature in the range of 100 to 400° C. (the base surface temperature) at which the oxide film is hardly generated on the surface of the metallic base. The metallic base is normally subjected to a blast treatment prior to the preheating step.

In the pre-spraying step, a glass material is pre-sprayed by a spraying apparatus onto the surface of the metallic base having been heated to a predetermined temperature in the preheating step, to form a pre-coating of the glass material. Since the pre-spaying is performed at the temperature in the range of 100 to 400° C. at which the oxide film is hardly generated, the glass pre-coating adheres to the surface of the metallic base in the form of scales in the incompletely molten state.

The glass pre-coating formed in the pre-spraying step has preferably a thickness of 50 to 200 $\mu$m as provided as the invention of claim 3.

In the main-spraying step, the glass pre-coating which has been formed in the pre-spraying step is additionally heated and the same glass material is main-sprayed at high temperature onto the surface thereof to form a glass coating which is formed unitedly with the glass pre-coating.

Namely, the surface of the glass pre-coating is heated to a temperature of 600 to 1000° C. by the additional heating and the same glass material as used for the glass pre-coating is sprayed while melting the glass pre-coating completely. With the main-spraying, the glass pre-coating is united with the glass material of the main-spraying to form a glass coating and a glass coating without air bubbles can be formed with preventing the generation of the oxide film.

According to the invention of claim 1, by the above described steps, the glass material can be sprayed onto the metallic base effectively and efficiently and it is possible to prevent the generation of pin holes in the glass coating and to largely improve the strength, adhesion and appearance of the glass coating.

The invention of claim 2 has a post-heating step following the main-spraying step stated in claim 1, of post-heating the glass coating which has been formed by main-spraying.

In the post-heating step, the temperature of the glass coating gradually decreases to 400 to 800° C. (slow cooling) after the main-spraying of the glass material, to prevent a sudden decrease in the temperature of the glass material after the main-spraying and to melt the glass material more completely. In the practical operation, the temperature of the glass coating during the main-spraying reaches above 1500° C. and decreases suddenly to 500 to 600° C. over a time period of one or two minutes after the main-spraying resulting in problems due to the heat shock. To avoid the problems, it is effective to decrease the temperature gradually over a period of time of 5 to 6 minutes (slow cooling) by the post-heating, after the main-spraying. In some cases, there may be half-molten parts, which have not completely molten, in the glass material just before the main-spraying. Therefor, for large products, it is preferably recommended to perform the post-heating which doubles as slow cooling, to melt the half-molten parts completely.

The invention of claim 4 and 5 relates to a method wherein a metallic roll base is used as the metallic base. The invention of claim 4 provides a glass spraying method wherein the metallic roll base is hold to be freely rotatable in the circumferential direction and each of the steps above is performed while rotating the metallic roll base.

According to the invention of claim 4, since the each step is performed while rotating the metallic in circumferential direction, the whole perimeter of the part of the base where the glass coating is supposed to be formed is uniformly subjected to the operation in the each step and the each step can be performed evenly, effectively and efficiently.

The invention of claim 5 is a glass spraying method of claim 4 wherein the pre-spraying step, the main-spraying step and the post-heating step are performed by an apparatus which moves continuously along the axial direction of the metallic roll base.

According to the invention of claim 5, the pre-spraying step, the main-spraying step and the post-heating step can be performed as a continuous sequential operation, more effectively and efficiently.

After the glass coating has been formed, the surface of the glass coating may be subjected to polishing or a top surface layer is formed thereon, if necessary, to make a final product. Or the metallic base can be a final product without such processes.

Next, an apparatus for spraying glass onto the metallic roll described in claim 6 or those thereafter will be explained.

An apparatus shown in FIG. 2 through 8 relates to a glass spraying apparatus to perform the above mentioned glass spraying method, for the metallic roll base, practically and effectively.

As shown in the drawings, the glass spraying apparatus relating to an invention of claim 6 includes each of a rotating and holding apparatus 20 which holds a metallic roll base 10, an entire heating apparatus 30 which heats the roll base 10 entirely, a pre-spraying apparatus 40 which sprays a glass material onto the surface of the roll base 10 in sequence to form a glass pre-coating 13, an additional heating apparatus 50 which additionally heats the glass pre-coating 13 locally and continuously, and a main-spraying apparatus 60 which sprays the glass material, in sequence, onto the surface of the glass pre-coating 13 having been additionally heated. The symbol 15 in the drawing represents a heating chamber and the upper part 15*a* of the heating chamber 15 may be freely opened and closed through a hinge part 16 to allow the roll base 10 to be loaded and unloaded as shown in FIG. 4.

The metallic roll base 10 which is made of metal such as stainless steel, comprises a roll body 11 and a shaft 12 at the both ends thereof A rotating and holding apparatus 20 which holds the metallic roll base 10 to be rotatable in the circumferential direction, has a driving motor 21, a driving shaft part 22 and a bearing part 23. As shown in FIG. 2, the roll base 10 is held by the driving shaft part 22 and the bearing part 23 at the shaft part 12 thereof and is rotated by the driving motor 21 in the direction of the arrow R in the drawing.

The entire heating apparatus 30 is disposed in the axial direction of the roll base 10 and heats the roll base 10 which is being rotated, entirely. In the example, the entire heating apparatus 30 comprises plurality of heating burners 31,31 which are disposed under the metallic roll base 10. Since the burners 31 are disposed at the same intervals in the axial direction of the roll base 10 and the roll base 10 is being rotated, all of the roll base 10 is heated evenly. The entire heating apparatus 30, as described above, heats the surface of the base to the preheat temperature for glass spraying of about 100 to 400° C.

The pre-spraying apparatus 40, as shown in FIG. 3 and 4, sprays a glass material, in sequence, onto the surface of the metallic roll base 10 which has been heated to the preheat temperature to form a glass pre-coating 13. The prespraying apparatus 40 is constituted to drive on rail 80 at a predetermined speed and moves in the axial direction of the roll base 10. As described above, the metallic roll base 10 is held to be rotatable in the circumferential direction by the rotating and holding apparatus 20. Accordingly, when the pre-spraying apparatus 40 moves in the axial direction of the roll base 10, the glass material is sprayed in sequence on the entire perimeter surface of the roll base 10. The pre-spraying apparatus may freely move by using a robot, etc. which is not shown in the drawings.

The glass spraying material used for the pre-spraying apparatus 40 is a powdery material capable of forming a glass (pre-) coating when sprayed. A frit which is adjusted to have a predetermined ratio of components is preferably used.

An additional heating apparatus 50 is, as shown in FIG. 5, additionally heats the glass pre-coating 13 having been formed on the surface of the roll base 10, locally and continuously. The additional heating apparatus 50 is constituted to drive on the rail 80 at a predetermined speed or to be moved by, for example, a robot in the axial direction of the roll base 10. The metallic roll base 10 is held to be rotatable in the circumferential direction by the rotating and holding apparatus 20. Accordingly, when the additional heating apparatus 50 moves along the axial direction of the roll base 10, the entire perimeter surface of the roll base 10 is heated in sequence.

With the additional heating by the additional heating apparatus 50, the glass material having been sprayed onto the roll base 10 is heated to a temperature preferable for forming a glass coating. The additional heating temperature (the surface temperature) provided by the additional heating apparatus 50 is about 600 to 1000° C.

The main-spraying apparatus 60 sprays the glass material in sequence onto the surface of the glass pre-coating 13, which has been formed on the surface of the roll base 10 and has been locally and continuously heated in addition by the additional heating apparatus 50, to form a glass coating. The main-spraying apparatus 60 is constituted to drive on the rail 80 at a predetermined speed or to be moved by, for example, a robot in the axial direction of the roll base 10. As stated above, the metallic roll base 10 is held to be rotatable in the circumferential direction by the rotating and holding apparatus 20. Accordingly, when the main-spraying apparatus 60 moves along the axial direction of the roll base 10, the glass material is sprayed in sequence onto the entire perimeter surface of the glass pre-coating 13 on the surface of the roll base 10.

The glass material used for the main-spraying apparatus 60 is the same as that used for the pre-spraying apparatus 40, preferably a frit having been adjusted to have a predetermined ratio of components as described above. The glass pre-coating 13 and the glass coating 14 are united to form a glass coating 14 of a high quality by using the same material as that used for the pre-spraying.

An apparatus shown in FIG. 5, is provided with a post-heating apparatus 70. The post-heating apparatus 70 is, as provided as the invention of claim 7, disposed on the rear side of the main-spraying apparatus 60 in the direction of travel thereof, after main-spraying the glass material by the main-spraying apparatus 60.

In the post-heating as stated above, after the main-spraying of the glass material, the glass coat 14 is gradually cooled to 400 to 800° C. by heating to prevent the sudden decrease in the temperature after the main-spraying and to ensure the complete melting of the glass material.

In the example shown in FIG. 5, as provided as the invention of claim 8, the main-spraying apparatus 60 is disposed on the rear side of the additional heating apparatus 50 and the post-heating apparatus 70 is disposed on the rear side of the main-spraying apparatus 60, the apparatuses of 50, 60 and 70 being constituted to move along the axial direction of the roll base 10 together at one time. Because of such a constitution, the part of the roll base 10 which has been additionally heated by the additional heating apparatus 50 can be subjected to the glass spraying by the main-spraying apparatus 60 effectively and the part of main-sprayed glass coating can be subjected to the post-heating effectively. The spacing between each of the apparatuses is from 5 to 10 cm, in the example.

EXAMPLE

Examples are described concretely below.

Example 1

A metallic roll base comprised a martensitic stainless steel, had a diameter of 300 mm and a length of 1500 mm and had been subjected to the surface blast treatment by the steel grid blast.

The metallic roll base was held by the rotating and holding apparatus in the chamber and was rotated at a peripheral speed of 3.5 m/min. The roll base held to be rotatable was heated to 400° C. by the entire heating apparatus using a LPG gas fuel.

While maintaining the roll base temperature at 400° C. by the use of the entire heating apparatus, the glass material was sprayed in sequence onto the part of the surface of the metallic roll base by the pre-spraying apparatus. In this example, the pre-spraying apparatus used oxygen and acetylene as a fuel and proceeded at a speed of 120 mm/min in the axial direction of the roll base in the same manner as the partially heating apparatus described above. The glass material was fed at the amount of 120 g/min. The glass pre-coating having a thickness of 150 $\mu$m was obtained by the pre-spraying. Thereafter, the additional heating apparatus using the LPG gas as a fuel, additionally heated the surface of the glass pre-coating partially so that the surface temperature of the heated portion reaches 800° C. The partially heating apparatus proceeded at a speed of 120 mm/min in the axial direction of the roll base.

The surface of the glass pre-coating which had been heated to 800° C. by the additional heating using the additional heating apparatus, was subjected to the main-spraying of the glass material in sequence by the main-spraying apparatus which was disposed on the rear side of the additional heating apparatus. In this example, the main-spraying apparatus used oxygen and acetylene like the pre-spraying apparatus and proceeded at a speed of 120 mm/min in the axial direction of the roll base like the additional heating apparatus. The glass material was fed at an amount of 120 g/min. After the main-spraying of the glass material, the glass coating was subjected to the post-heating so that the temperature thereof was gradually cooled to 500° C. In this manner, the glass coating having a thickness of about 1 mm was formed on the entire perimeter surface of the roll base held to be rotatable.

The composition of the glass material used in this example (% by weight) was as follows.

$SiO_2$: 52%
$B_2O_3$: 15%
$Al_2O_3$: 4%
$Li_2O$: 7%
CaO: 2%
$ZrO_2$: 10%
SrO: 5%
ZnO: 5%

Example 2

A metallic roll base made of an austenitic stainless having a diameter of 400 mm and a length of 1800 mm was processed in the same manner as that of the above Example 1 up to the additional heating.

In Example 2, a glass material having the following composition (% by weight) was used.

$SiO_2$:72%
$B_2O_3$: 1%
$Al_2O_3$: 3%
$Li_2O$: 22%
SrO: 2%

Two plasma spraying apparatuses (F4-MB manufactured by Plasmadyne Corp.) were used in parallel to obtain a particularly thick glass coating. The condition of the spraying apparatus used was argon 40 L/min and hydrogen 10 L/min as a plasma gas, a plasma current of 650 A and a voltage of 65 V. The glass material was fed at the amount of 110 g/min and the roll base was rotated at a peripheral speed (rotating speed) of 4 m/min. Thereafter, the post-heating was performed using the post-heating apparatus so that the temperature of the glass coating gradually decreased to 550° C. In this example, the additional heating apparatus, the main-spraying apparatus and the post-heating apparatus moved at a speed of 10 mm/min. In this example, a glass coating having a thickness of 1.8 mm was obtained by the glass spraying.

The glass coating formed by the method and the glass spraying apparatus explained above is cooled thereafter, preferably by slow cooling although it may be allowed to undergo spontaneous cooling. The slow cooling is preferably performed using a known slow cooling furnace at a cooling rate of about 50° C. per hour.

After cooling, finish polishing is performed to make the surface of the metallic roll base smooth. The polishing is performed to obtain a predetermined thickness by a known method such as diamond polishing.

The glass material is sprayed on the entire or a part of the surface of the metallic roll base. Depending on the use of the product, for example, when a electrically conductive part is required, a partial spraying wherein a part of the surface remains uncovered with the nonconductive glass material may be performed or a predetermined part of the glass coating may be cut away after spraying the entire surface of the roll base.

It is possible to form a top surface layer (sprayed coating) of other ceramics or metals on the upper surface of the glass coating after spraying the glass material with or without polishing. For example, ceramics such as alumina (aluminum oxide), an alumina compound, zirconia (zirconium oxide), a zirconia compound, chromium oxide, and a chromium oxide compound and a mixture or a compound thereof, and metals such as tungsten carbide and chrome carbide may be sprayed depending of the use and function of the roll.

As explained with reference to the drawings above, according to the glass spraying method of the present invention, the spraying of the glass material on the metallic base can be performed effectively and efficiently. In particular, the generation of pin holes in the glass coating can be prevented and the strength, adhesion and appearance of the glass coating can be improved, by providing the glass pre-coating comprising the glass material between the metallic base and the glass coating.

Furthermore, the present invention provides a glass spraying apparatus useful for a metallic roll base, particularly a large metallic roll base. In particular, a coating comprising a glass material can be formed continuously and efficiently using the glass spraying apparatus wherein a metallic roll base is held to be rotatable in the circumferential direction by a rotating and holding apparatus, the metallic roll is preheated by an entire heating apparatus, the glass material is sprayed in sequence onto the surface of the base which has been preheated by the entire heating apparatus by a pre-spraying apparatus moving in the axial direction of the metallic base, the glass pre-coating is additionally heated by an additional heating apparatus, and the glass material is main-sprayed in sequence onto the surface of the glass pre-coating which has been additionally heated, by a main-spraying apparatus to form a glass coating.

What is claimed is:

1. A glass spraying apparatus comprising, a rotating and holding apparatus which holds a metallic roll base and rotates the same in the circumferential direction thereof, an entire heating apparatus disposed in the axial direction of the roll base to heat the roll base entirely, a pre-spraying apparatus which moves along the axial direction of the roll base and sprays a glass material onto the surface of the roll base in sequence to form a glass pre-coating, an additional heating apparatus which moves along the axial direction of the roll base and heats additionally the glass pre-coating locally and continuously, and a main-spraying apparatus disposed on the rear side of the additional heating apparatus in the direction of travel thereof, which sprays a glass material in sequence onto the surface of the glass pre-coating which has been additionally heated.

2. A glass spraying apparatus according to claim 1, further comprising a post-heating apparatus disposed on the rear side of the main-spraying apparatus in the direction of travel thereof, which heats the glass-coating which has been subjected to the main-spraying.

3. A glass spraying apparatus according to claim 1 or 2, wherein the additional heating apparatus, the main-spraying apparatus, and the post-heating apparatus are arranged so that they are moved together at one time.

* * * * *